US010766659B2

(12) United States Patent
Wang et al.

(10) Patent No.: US 10,766,659 B2
(45) Date of Patent: Sep. 8, 2020

(54) CONTAINER, BLANK, MODULAR DISPLAY DEVICE, AND METHOD FOR FORMING A DISPLAY DEVICE FROM THE MODULAR DISPLAY DEVICE

(71) Applicant: Intercontinental Great Brands LLC, East Hanover, NJ (US)

(72) Inventors: Yan Wang, Suzhou (CN); Kane Jacker, Singapore (SG); Sam Douglas, Singapore (SG)

(73) Assignee: Intercontinental Great Brands LLC, East Hanover, NJ (US)

( * ) Notice: Subject to any disclaimer, the term of this patent is extended or adjusted under 35 U.S.C. 154(b) by 0 days.

(21) Appl. No.: 16/333,187

(22) PCT Filed: Sep. 19, 2017

(86) PCT No.: PCT/IB2017/001167
§ 371 (c)(1),
(2) Date: Mar. 13, 2019

(87) PCT Pub. No.: WO2018/060763
PCT Pub. Date: Apr. 5, 2018

(65) Prior Publication Data

US 2019/0225364 A1 Jul. 25, 2019

(30) Foreign Application Priority Data

Sep. 29, 2016 (CN) ..... 2016 1 0866480

(51) Int. Cl.
*B65D 5/00* (2006.01)
*B65D 5/42* (2006.01)
(Continued)

(52) U.S. Cl.
CPC ..... *B65D 5/003* (2013.01); *A47B 55/06* (2013.01); *A47B 87/0269* (2013.01); *A47F 5/114* (2013.01); *B65D 5/427* (2013.01)

(58) Field of Classification Search
CPC ..... B65D 5/003; B65D 5/427; B65D 21/048; B65D 5/0035; B65D 5/001; B65D 5/5266;
(Continued)

(56) References Cited

U.S. PATENT DOCUMENTS 2,046,751 A * 7/1936 Ferdinand ..... B65D 5/4204 206/745
2,843,307 A * 7/1958 Goltz ..... B65D 5/22 206/509
(Continued)

FOREIGN PATENT DOCUMENTS

CN 103340541 10/2013
CN 103958357 7/2014
(Continued)

OTHER PUBLICATIONS

International Search Report and Written Opinion of the International Searching Authority, dated Nov. 20, 2017 for International Application No. PCT/US2017/001167 (11 pgs.).
(Continued)

*Primary Examiner* — Jennifer E. Novosad
(74) *Attorney, Agent, or Firm* — Fitch, Even, Tabin & Flannery LLP

(57) ABSTRACT

A container (10) comprising one or more walls (12, 14, 16) and a base (18) defining an enclosure for storing and displaying one or more items (90). A locking tab (22) is defined in each side wall (16) and corresponding locking slots (26) are defined in the base (18). The locking tabs (22) each define an undercut (22*c*). The container (10) can be
(Continued)

mounted on top of a further container (10) to form a modular display device by inserting the locking tabs (22) of the further container into the locking slots (26) and sliding the container forwardly to engage the base (18) in the undercuts. The modular display device (34, FIG. 3) may also include a stand for supporting one or more containers at an angle on a horizontal surface and a header.

18 Claims, 6 Drawing Sheets

(51) Int. Cl.
*A47B 55/06* (2006.01)
*A47B 87/02* (2006.01)
*A47F 5/11* (2006.01)

(58) Field of Classification Search
CPC .. A47F 5/114; A47F 5/11; A47F 5/112; A47F 5/116; A47B 87/0276; A47B 43/02; A47B 47/06; A47B 55/06; A47B 61/06; A47B 87/02; A47B 87/0207; A47B 87/0261; A47B 87/0269
USPC ..... 211/72, 73, 126.2, 126.6, 126.16, 128.1, 211/132.1, 135, 194; 229/915, 195, 178, 229/157
See application file for complete search history.

(56) References Cited

U.S. PATENT DOCUMENTS 3,006,523 A * 10/1961 Keith ..... B65D 5/0015 229/120.37
3,208,659 A * 9/1965 Otto ..... A47F 5/112 229/120.17
3,287,075 A * 11/1966 Batke ..... B65D 5/38 312/108
3,438,508 A * 4/1969 Kuns ..... A47F 5/116 211/126.16
3,862,689 A * 1/1975 Taub ..... A47B 87/0253 211/126.2
4,245,773 A * 1/1981 Stollberg ..... B65D 5/003 206/509
4,550,837 A 11/1985 Simmons
4,708,240 A * 11/1987 McMahon ..... A47F 5/114 206/45.25
4,911,311 A * 3/1990 Nagai ..... A47F 5/116 211/11
5,029,710 A * 7/1991 Workman ..... B65D 5/001 206/503
5,039,002 A * 8/1991 Spamer ..... B65D 5/2038 206/429
5,069,335 A * 12/1991 Beales ..... B65D 5/427 206/144
5,141,117 A * 8/1992 Olsen ..... A47B 87/0269 211/194
5,161,699 A * 11/1992 Hanna ..... A47F 5/11 211/130.1
5,193,466 A * 3/1993 Eder ..... A47F 5/116 108/166
5,392,902 A * 2/1995 Vlastakis ..... A47B 57/00 108/165
5,441,151 A * 8/1995 Billingham ..... A47B 63/00 206/425
5,630,518 A * 5/1997 Collins ..... A47F 5/112 211/132.1
5,758,783 A * 6/1998 Maglione ..... A47B 87/0207 211/126.16
5,860,590 A 1/1999 Blomfield
5,894,933 A 4/1999 Crews
5,984,120 A * 11/1999 Johnske ..... A47F 5/114 211/126.16
6,012,582 A * 1/2000 Haygeman ..... B65D 5/001 206/503
6,105,796 A * 8/2000 Buchanan ..... A47F 9/04 186/59
7,111,743 B1 * 9/2006 Moss ..... A47F 5/116 211/130.1
D654,726 S * 2/2012 Nealon ..... D6/683.1
8,360,255 B2 * 1/2013 Chen ..... A47B 43/02 211/135
9,056,694 B2 6/2015 Aksan
9,211,020 B2 * 12/2015 Hodge ..... A47F 5/0025
9,290,288 B1 * 3/2016 Ikeno ..... A47F 5/116
9,932,141 B2 4/2018 Collier
2005/0040217 A1 2/2005 Fry
2006/0213960 A1 * 9/2006 Kenny ..... B65D 5/003 229/125.01
2014/0014602 A1 1/2014 Ray
2014/0374303 A1 * 12/2014 Martinez ..... B65D 5/003 206/508
2015/0068945 A1 * 3/2015 Baker ..... B65D 5/0055 206/509
2015/0068946 A1 * 3/2015 Baker ..... B65D 5/0015 206/509
2018/0354677 A1 * 12/2018 Dorminey ..... B65D 5/003
2019/0112093 A1 * 4/2019 Delause ..... B65D 5/0015
2019/0225364 A1 * 7/2019 Wang ..... B65D 5/427

FOREIGN PATENT DOCUMENTS

| | | |
|---|---|---|
| CN | 104724343 | 6/2015 |
| CN | 105473454 | 4/2016 |
| DE | 10303556 | 8/2004 |
| EP | 1118296 | 7/2001 |
| FR | 1581001 | 9/1969 |
| FR | 2720052 | 11/1995 |
| FR | 2848184 | 6/2004 |
| JP | S6228344 | 2/1987 |
| WO | 15028880 | 3/2015 |

OTHER PUBLICATIONS

International Preliminary Report on Patentability, dated Apr. 11, 2019 for International Application No. PCT/US2017/001167 (7 pgs.).
Notification of Reasons for Refusal, dated Jan. 29, 2020 for Japanese Application No. 2019-512611, with English translation (13 pgs.).
European Examination Report dated May 6, 2020, for European Application No. 17781535.4 (5 pgs.).
Notification of the First Office Action, dated Jul. 1, 2020 for China Application No. 201610866480.9.

* cited by examiner

CONTAINER, BLANK, MODULAR DISPLAY DEVICE, AND METHOD FOR FORMING A DISPLAY DEVICE FROM THE MODULAR DISPLAY DEVICE

CROSS REFERENCE TO RELATED APPLICATIONS

This application is a U.S. national phase application of International Application No. PCT/IB2017/001167, filed Sep. 19, 2017, which claims benefit from Chinese Application No. 201610866480.9, filed Sep. 29, 2016, which are each hereby incorporated herein by reference in their entirety.

TECHNICAL FIELD OF THE INVENTION

The present invention relates to containers, and in particular to containers which may be used to form a modular display device. The invention relates in particular to containers which can stacked on top of one another to display items located therein. The invention also relates to methods of forming a modular display device comprising at least one such container, to a modular display device and to a blank.

BACKGROUND TO THE INVENTION

It is known to provide a display unit for confectionery items and the like which is formed of a series of compartments positioned above one another. These compartments may in some instances be held in position by a support structure which is typically constructed from a metal or plastics material. However, such units are relatively expensive to construct and must be restocked with items which are generally stored in additional packaging.

To overcome these issues, it is known to provide items in "shelf-ready packaging" ("SRP") which can be used to transport, store and subsequently display the items without the need for an additional display unit. Furthermore, SRP is typically constructed from cartonboard or the like which reduces manufacturing costs. SRP of this type commonly includes a base and a cover removable from the base by tearing along perforations in the packaging material. When removed, the cover may be used as a stand on which the base may be placed to form the display unit. Furthermore, removing the cover provides an opening in the base to display items located therein.

In some examples of SRP, the cover may comprise an inclined surface on which the base sits. In this way, when the base is positioned on the cover it is angled with respect to a horizontal axis to better display items located within the display to potential customers. However, SRPs of this type are limited in the sense that the formed display unit is restricted to the angled configuration determined by the incline of the surface on the cover.

Furthermore, increasing the angle at which the containers in the display unit are positioned creates additionally stability issues, where the containers may become top heavy when stocked with items and therefore more likely to topple or where upper containers may slide relative to lower containers. It is therefore a requirement for any display unit comprising stacked containers to be sufficiently stable at the angle at which the containers are inclined. If the incline is to be varied, the stacked containers must be sufficiently stable at a range of angles. However, no solution has been provided which addresses this issue.

It is therefore an aim of an embodiment or embodiments of the invention to overcome or at least partially mitigate the problems associated with the prior art, or any other problem of vertically stackable packaging containers.

SUMMARY OF THE INVENTION

In accordance with a first aspect of the invention, there is provided a container constructed from a blank of foldable material and adapted to be stacked together with other similar containers to form a modular display, the container comprising a base, a pair of opposed side walls extending upwardly from the base, and opposed front and rear walls extending upwardly from the base between said opposed side walls, said base and said walls defining an enclosure for storing and displaying one or more items, a locking tab defined in each side wall and a pair of corresponding locking slots defined in the base, the locking tabs and locking slots being configured such that, in use, a first container is detachably mountable on a second container by insertion of the locking tabs of the second container into the corresponding locking slots of the first container; wherein each projecting tab comprises a neck portion and a body portion with the body portion overhanging the neck portion to define an undercut.

In an embodiment, the undercut opens in a rearward direction.

In an embodiment, each locking tab is defined at a rearward end of its respective side wall.

In an embodiment, the corresponding locking slots are defined in the base at positions which are offset forwardly from their respective locking tabs such that, in use, when a first container is mounted to a second container, the front wall of the upper, first container is offset rearwardly from the front wall of the lower, second container.

In an embodiment, the locking tabs and locking slots are configured such that, in use, a first container is mountable on top of a second container with the body portion of each of the locking tabs of the second container inserted through a corresponding locking slot in the first container and the base of the first container engaging within the undercut.

In an embodiment, a first recess is defined in the upper edge of each of the opposed side walls, each first recess extending from a forward edge the respective locking tab forwardly over part of the remaining length of the side wall. In an embodiment, the container is configured such that, in use, when a first container is mounted on top of a second container, a region of base of the first container between a forward edge of the locking slots and the front wall is received in the first recesses of the second container. In an embodiment, each first recess is are longer than the distance between the forward end of the locking slots and the front wall.

In an embodiment, the base is planar and the uppermost edges of the opposed side walls are parallel to the plane of the base.

In an embodiment, each of the opposed side walls comprises an inner panel and an outer panel, the inner panel defining a second recess in a lower edge region of the panel in alignment with a respective one of the locking slots, the second recess being configured to receive at least a body portion of the locking tab of a further container when inserted though the locking slot in use to mount the container to said further container.

In accordance with a second aspect of the invention, there is provided a blank for the manufacture of the container according to the first aspect, the blank comprising:

first and second side wall sections, a rear edge of each side wall section being profiled to define a locking tab in the completed container;

a front wall panel and a rear wall panel;

a base panel connected by fold lines along a first set of opposing end edges to the front and rear panels, and along a second set of opposing side edges to the first and second side wall sections, the base comprising a pair of opposed locking slot apertures located along respective side edges.

In an embodiment, each side wall section comprises inner and outer side wall panels separated by one or more fold lines, the rear edges of the inner and outer panels in each side wall section being profiled to define a locking tab when the blank is folded to form a container. In an embodiment, the front wall panel and the rear wall panel each have a securing flap connected to either side edge by a fold line, the securing flaps being configured for insertion between the inner and outer side wall panels of a respective side wall when the blank is folded to form a container. In an embodiment, each of the securing flaps connected to the rear wall panel are profiled along a rear edge to define a locking tab together with the inner and outer side wall panels of their respective side wall sections when the blank is folded to form a container. In an embodiment, each side wall section defines an aperture spanning the inner and outer side wall panels over part of their length, the aperture defining a forward edge of the locking tab and a first recess in the upper edge of the respective side wall when the blank is folded to form container.

In accordance with a third aspect of the invention, there is provided a modular display device comprising at least one container in accordance with the first aspect of the invention.

In an embodiment, the modular display device comprises two or more containers in accordance with the first aspect of the invention mountable one above another to form a stack, wherein the containers are connectable together in adjacent pairs to form the stack by means of the locking tabs in a lower container of each pair being inserted in the respective locking slots of the upper container in each pair, with the base of the upper container in each pair engaging in the undercut defined in the locking tabs of the lower container in each pair.

In an embodiment, the modular display device comprises a stand or base to which said at least one container can be mounted, the stand being made from a blank of foldable material and comprising a pair of side walls connected along fold lines to opposing side edges of a rear wall, the side walls having upper surfaces which are inclined downwardly from the rear wall toward a forward edge, a locking tab projecting form the upper surface of each side wall for insertion in a respective locking slot of said at least one container.

In an embodiment, the locking tabs on the stand each comprise a neck portion and a body portion overhanging the neck portion to define an undercut, the base of the at least one container being engageable in the undercut.

In an embodiment wherein two or more containers are arranged in a stack, a lowermost container in the stack is mountable to the stand.

In an embodiment, the display device comprises a header mountable to said at least one container. In an embodiment, the header is formed from a blank of foldable material.

In an embodiment, the header has a substantially planar display surface configured to extend parallel to the plane of the base of a container to which it is mounted.

In an embodiment in which two or more containers are arranged in a stack, the header is mountable to an uppermost container in the stack.

In accordance with a fourth aspect of the invention, there is provided a method for forming a display device from the modular display device according to the third aspect, the method comprising detachably mounting at least two containers one above another to form a stack, a first container in each adjacent pair of containers in the stack being mounted on top of a second container in each adjacent pair by inserting each locking tab of the second container through a respective locking slot of the first container, the base of the first container engaging in the undercuts defined by the locking tabs of the second container.

In an embodiment where the modular display device comprises a stand, the method includes mounting a lowermost container in the stack to the stand by inserting each locking tab of the stand within a respective locking slot of the lowermost container, the base of the lowermost container engaging in the undercuts defined by the locking tabs of the stand.

In an embodiment where the modular display device comprises a header, the method includes mounting the header to an uppermost container in the stack.

In any of the above aspects of the invention, the container or containers may comprise one or more items located therein, which items may be food or drink items including confectionery items such as a gum or candy, snack products such as biscuits or cheese and the like or indeed any suitable items for display.

DESCRIPTION OF THE DRAWINGS

In order that the invention may be more clearly understood embodiments thereof will now be described, by way of example only, with reference to the accompanying drawings, of which.

DETAILED DESCRIPTION

Figure 1:
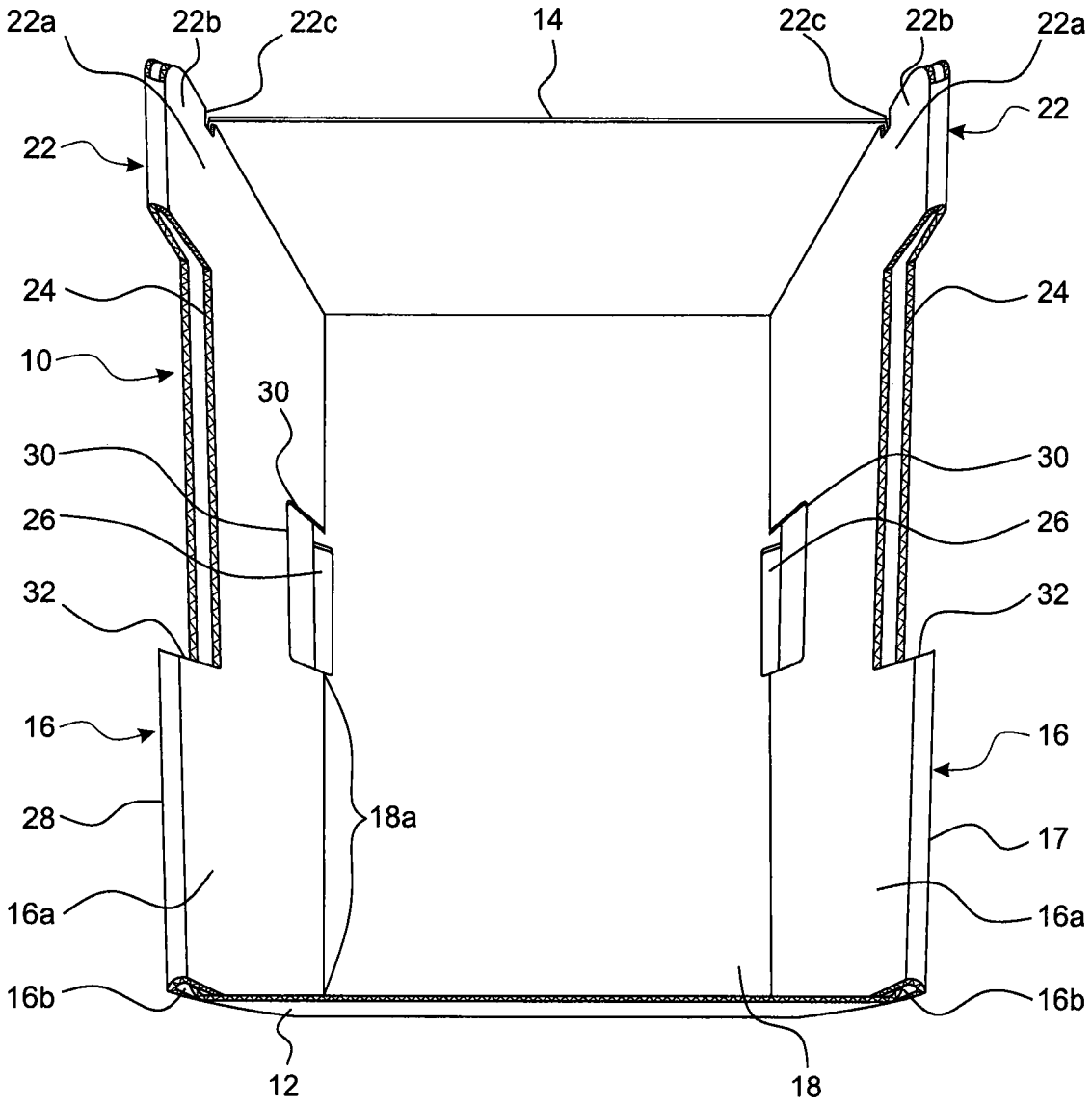
FIG. 1 is a perspective view of an embodiment of a container in accordance with an aspect of the invention.

An embodiment of a container 10 in accordance with an aspect of the invention is shown in FIG. 1. The container 10 has a front wall 12, rear wall 14, a pair of opposed side walls 16 and a base (or bottom) 18. The walls 12, 14, 16, and the base 18 define a substantially cuboidal enclosure for housing one or more items, in use.

An upper end region of each side wall 16 is profiled to define a locking tab 22 at a rear end and a first recess 24 extending from a forward end of the locking tab 22 over part of the length of the walls. The container 10 additionally defines a pair of corresponding locking slots 26 in the base, into which the locking tabs 22 of a further container 10 can be inserted to mount the containers one above the other in a stack. The locking tabs 22 each comprise a neck portion 22*a* and a body portion 22*b*. The body portion 22*b* of each tab is wider than the corresponding neck portion 22*a* such that it overhangs the neck portion resulting in respective undercut regions 22*c* which open in a rearward direction. The body portions 22*b* and undercut regions 22*c* cooperate with the base 18 of a further container to detachably connect the container 10 with said further container as will be described below.

Figure 2:
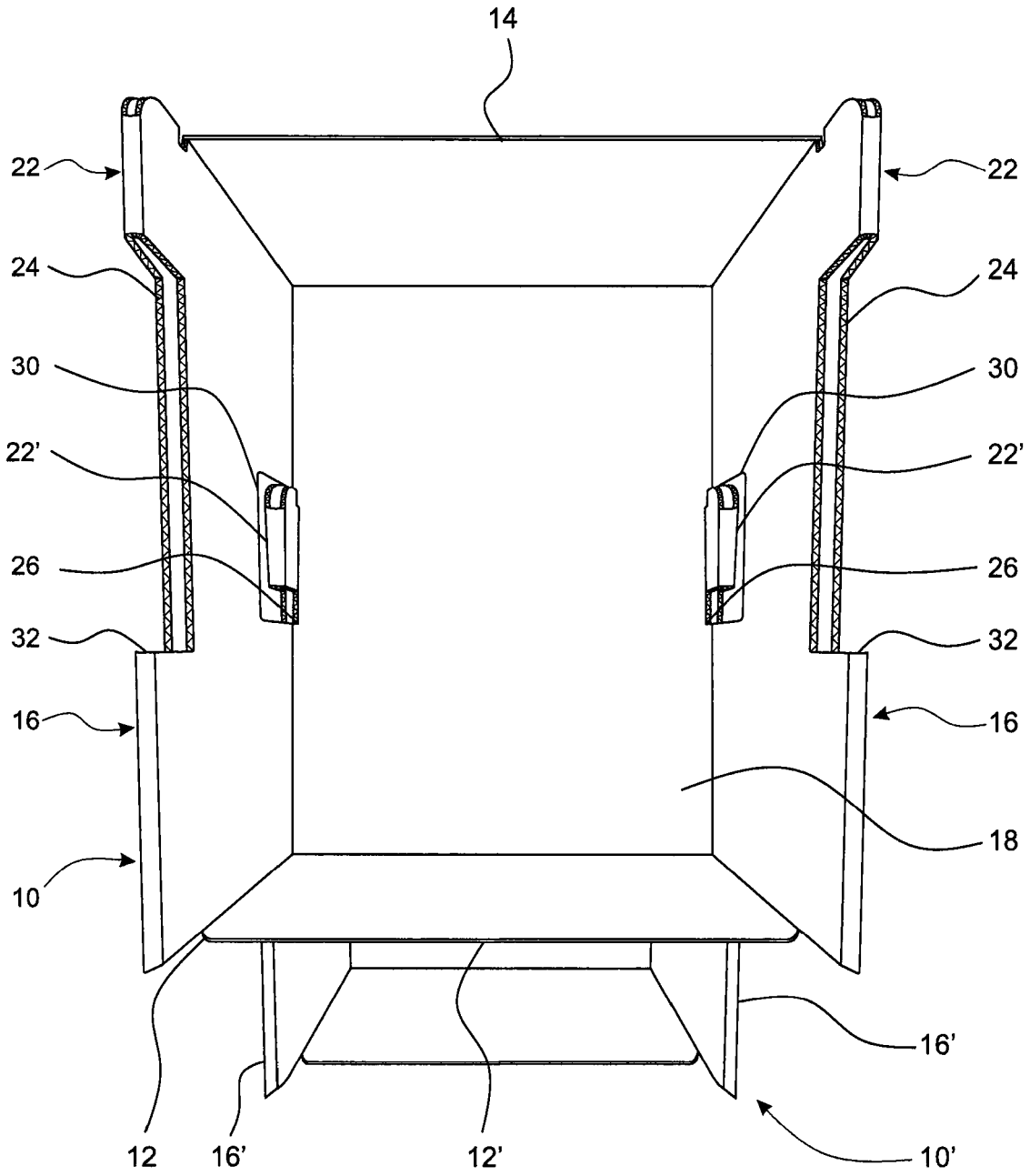
FIG. 2 is a further perspective view of the container shown in FIG. 1 mounted to a further container.
Figure 3:
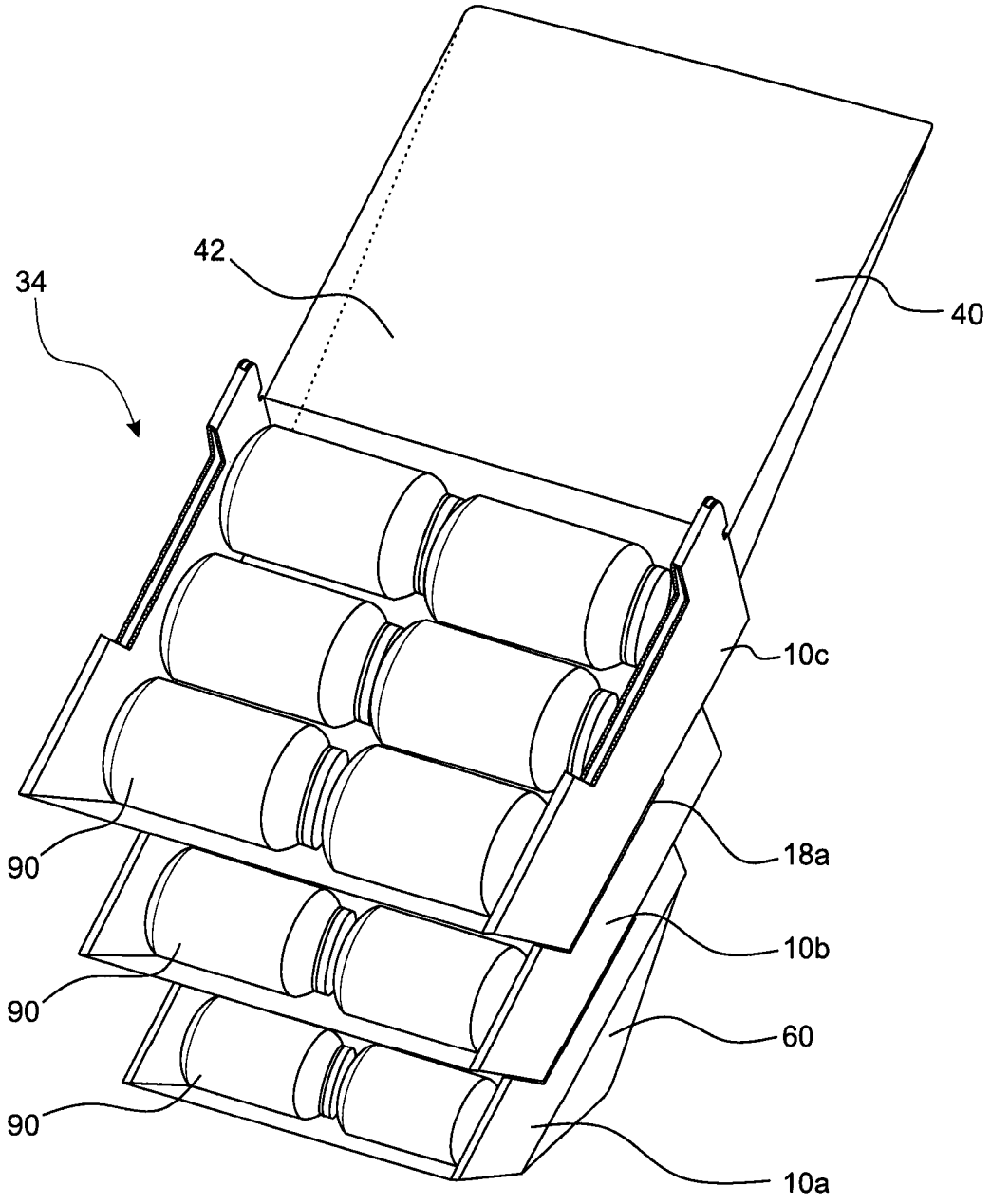
FIG. 3 is a perspective view of an embodiment of a modular display device in accordance with an aspect of the invention.

The container 10 is configured to form part of a modular display device, in which two or more such containers 10 can be detachable mounted one above the other in a stack as illustrated in FIGS. 2 and 3. When forming the stack, each adjacent pair of containers in the stack are connected together with locking tabs 22 of a lower container in the pair inserted into the locking slots 26 of the upper container. Each side wall 16 has an inner wall panel 16*a* and an outer wall panel 16*b* interconnected along the upper edge 17 of the side wall by fold lines. A second recess 30 is defined in the lower edge of the inner wall panel 16*a* adjacent the respective locking slot 26. The second recess 30 is dimensioned to receive at least the body portion 22*b* of a respective locking tab 22 when inserted through the locking slot 26. The locking tab 22 is therefore recessed into the side wall 16 so that it does not encroach into the volume for holding product which is defined between the inner surfaces of the inner panels 16*a* of the side walls.

The locking slots 26 are positioned offset forwardly from the locking tabs 22, so that when one container 10 is mounted to another, the front wall 12 of the upper container is offset rearwardly from the front wall 12 of the lower container 10. This produces a staggered display in which the interior volume of the lower container is accessible to allow a consumer to view and remove the contents of the lower container 10.

The first recesses 24 in the upper edges of the side walls 16 are arranged so that when a first container 10 is mounted on top of a second container 10', as illustrated in FIG. 2, a portion 18*a* of the base 18 of the first container is received in the first recess. The first recesses 24 are slightly longer than the distance from a forwarded edge of the locking slots 26 to the front wall 12 of the container 10. The length of the first recesses 24 is selected such that during mounting of the first container 10 to the second container 10', the locking tabs 22' of the second container are inserted through the locking slots 26 of the first container 10 until at least the body portion 22*b*' of the locking tabs are above the base 18 of the first container and the first container 10 slid forwardly relative to the second container 10' so that the base 18 of the first container at the rearward end of the locking slots 26 enters the undercuts 22*c*, with the front wall 12 of the first container abutting a surface 32 of the side wall defining a forward edge of the first recess 24 in the second container 10'. This configuration securely connects the containers 10, 10' and enables the containers to be inclined with their bases at any angle (between 0° and 90°) with respect to the horizontal axis. In addition, the first container 10 is offset rearwardly with respect to the second container 10' such that the interior of both containers 10, 10' is accessible even when in a stacked configuration, as shown.

FIG. 3 is a perspective view of a modular display device 34 formed from containers 10*a*, 10*b*, 10*c* in accordance with the invention. As shown, the display device 34 is formed from three separate containers, a first container 10*a*, a second container 10*b* and a third container 10*c*, stacked one on top of the other. Specifically, the second container 10*b* is stacked on top of the first container 10*a* to form a first adjacent pair of containers in the stack, and the third container 10*c* is stacked on top of the second container 10*b* to form a second adjacent pair of containers in the stack. Each adjacent pair of containers (10*a* and 10*b*, 10*b* and 10*c*) in the stack are detachably mounted to one another in the same manner as the first and second containers 10, 10' shown in FIG. 2 and described above.

The display device 34 as shown in FIG. 3 also includes a stand or base 60 onto which the first, lowermost container 10*a* is mounted and a header 40 securely connected to the third, uppermost container 10*c*. When mounted on the stand 60, the containers 10*a*, 10*b*, 10*c* are angled with respect to a horizontal surface on which the stand 60 is positioned. The header 40 is connected to the uppermost container, the third container 10*c* in the illustrated embodiment, and comprises a display surface 42 which may include indicia such as advertising slogans, logos, trade marks, prices, etc. referring to the item(s) contained within the display 90.

Figure 4:
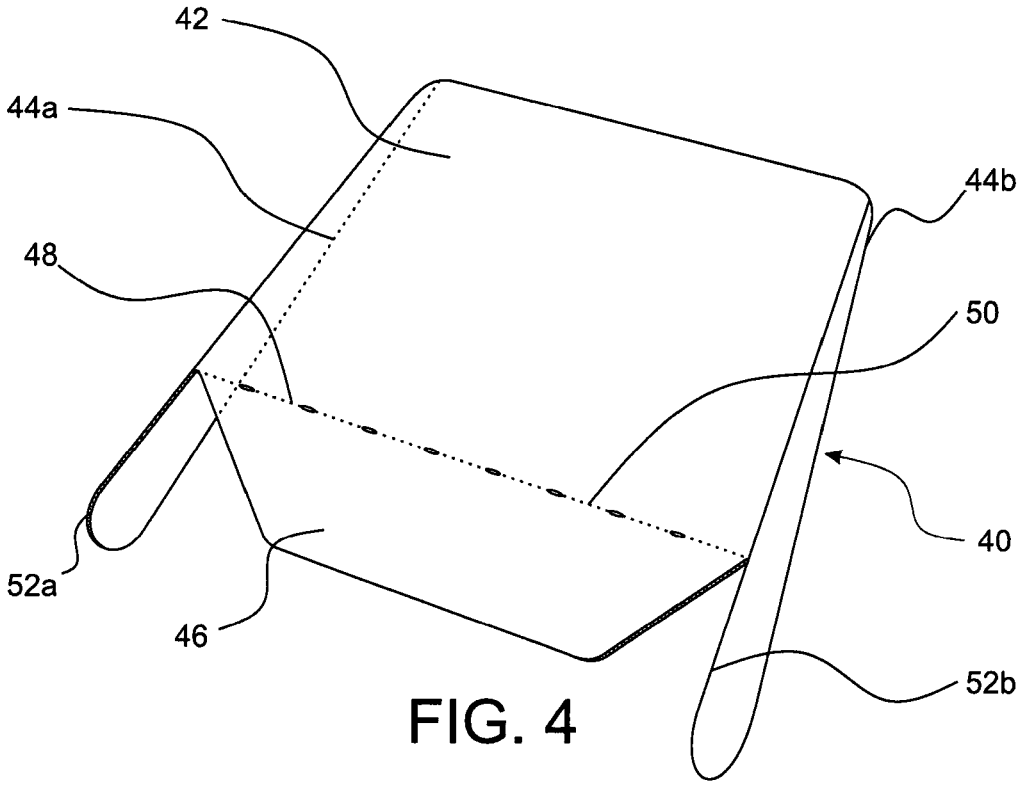
FIG. 4 is a perspective view of an embodiment of a header forming part of the modular display device of FIG. 3.
Figure 5:
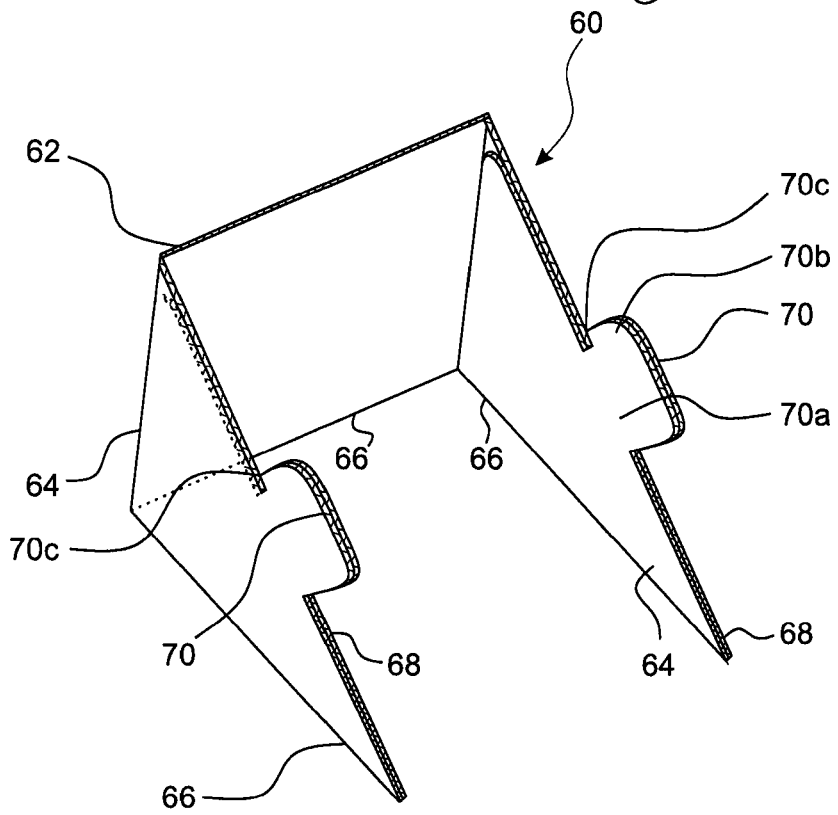
FIG. 5 is a perspective view of an embodiment of a stand forming part of the modular display device of FIG. 3.

FIGS. 4 and 5 illustrate the construction of the header 40 and stand 60.

As shown in FIG. 4, the header 40 includes a planar display surface 42 which is integrally formed with opposing side walls 44*a*, 44*b* and a securing flap 46 at the front. In the illustrated embodiment, the securing flap 46 is connected along an edge 48 of the display surface 42 which includes a series of perforations 50 along its length to aid in folding. The ends of the side walls 44*a*, 44*b* extend beyond the edge 48 of the display surface and form securing tabs 52*a*, 52*b*. The securing flap 46 and securing tabs 52*a*, 52*b* are used to securely connect the header 40 to a container 10*c* within the display device 34. Specifically, in the illustrated embodiment the securing flap 46 is positioned to overlay the rear wall 14 of the uppermost container 10*c* in the display device 34, with the securing tabs 52*a*, 52*b* inserted between the inner and outer side wall panels 16*a*, 16*b* of respective side walls 16 of the container.

As shown in FIG. 5, the stand 60 includes a rear wall 62 which is integrally formed with opposing side walls 64 that project forwardly of the rear wall 62. The lower edges 66 of the rear and side walls 62, 64 are coplanar. The upper edges 68 of the side walls are inclined downwardly in a direction from the rear wall 62 to a forward end so that the side walls 64 taper. A locking tab 70 projects from the upper surface 68 of each side wall 64. The locking tabs 70 are configured in the same way as tabs 22 on the container 10 and have wider body portions 70*b* and narrower neck portions 70*a* to define a rearwardly directed undercut 70*c* which opens in a rearward direction proximal to the upper surface 68 of the side walls 64. The locking tabs 70 on the stand 60 are used to securely connect a container 10 to the stand 60. Specifically, in the illustrated embodiment of FIG. 3, the tabs 70 are inserted through the locking slots 26 of the lowermost container 10*a* in the stack, and the container 10*a* is slid forwardly so that the base 18 of the container 10*a* engages in the undercuts 70*c* to lock the container to the stand 60. When in this position, the base 18 of the container 10*a* rests on the inclined upper surfaces 68 of the side walls 64 and the upper surface of the rear wall 62 of the stand 60 and is angled with respect to a horizontal axis as shown in FIG. 3.

The stand 60 is used to support a stack of containers 10*a*, 10*b*, 10*c* on a horizontal surface, such as a retail counter, so as to form a retail display stand in which the containers are inclined relative to the surface of the counter at an angle which is determined by the angle of inclination of the upper surfaces 68 of the side walls 64. Typically, the angle of inclination will be in the region of 45 degrees but can be varied to suit any particular application. For example, the angle of inclination might typically be in the range of 30 to 60 degrees. In a modular system, a range of stands 60 having side walls whose upper surfaces are inclined at different angles can be provided so that a retailer can select the most appropriate stand 60 when assembling the modular display device. The stand 60 is dimensioned to stably support the stack of containers with the side walls 64 of the stand spaced apart by the same distance as the side walls 16 of the containers 10 and the rear wall 62 of the stand in-line with the rear wall 14 of the container.

Whilst is expected that a modular display device 34 in accordance with the invention will usually comprise at least two containers 10 arranged in a stack, a display device 34 could be formed using only one container 10 mounted to a stand 60, optionally with a header 40 mounted to the same container 10.

The container 10, the header and the stand 60 are all formed from blanks of foldable material such as cardboard or carton board or the like. The outer surfaces of the material at least may be printed on to carry suitable graphics for the display.

Figure 6:
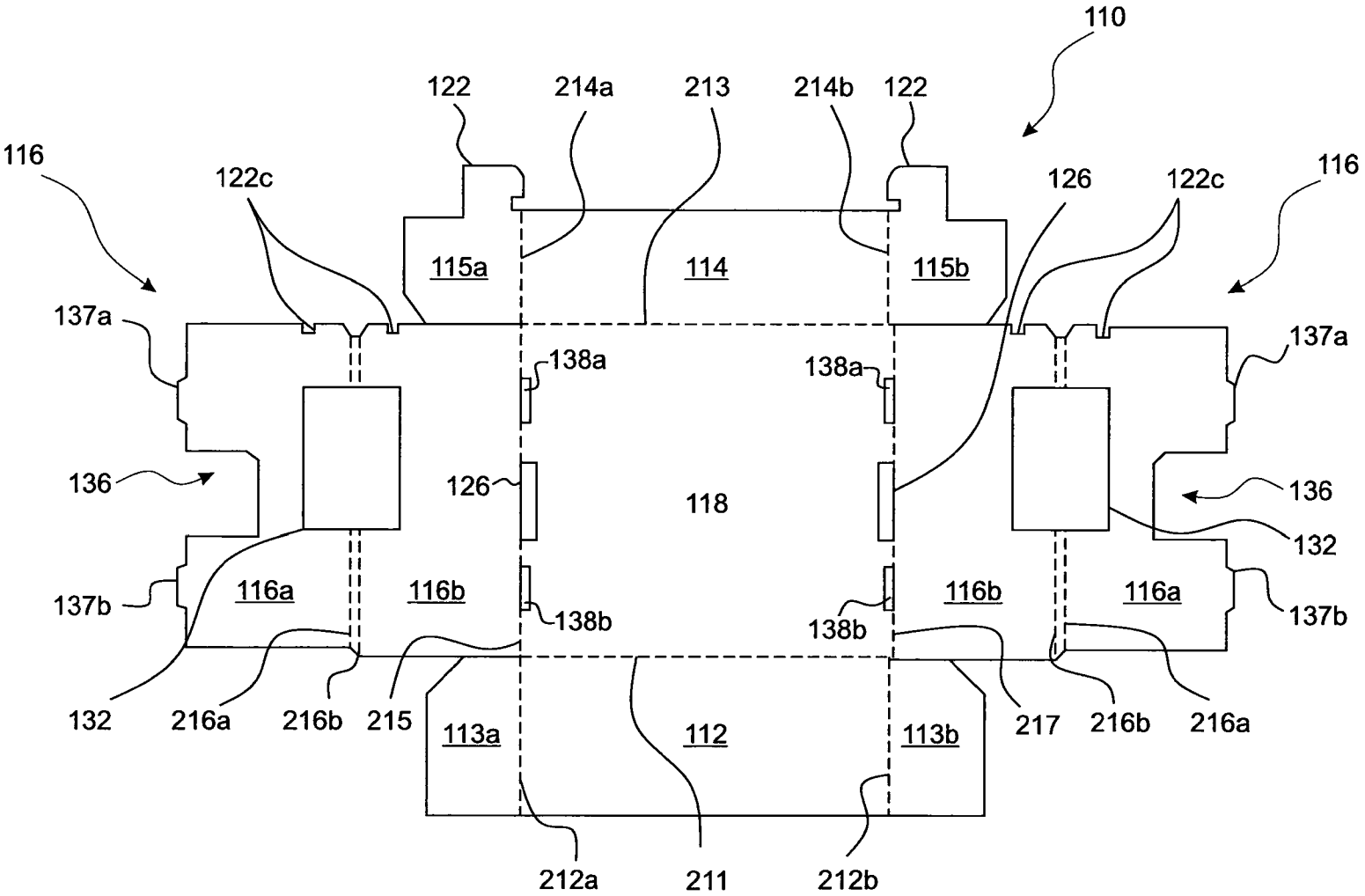
FIG. 6 is a plan view of an embodiment of a blank in accordance with an aspect of the invention for forming the container of FIG. 1.

FIG. 6 illustrates a blank 110 used to construct the embodiment of the container 10 of the present invention as shown in the preceding figures. The blank 110 comprises a base panel 118 and a pair of opposed side wall sections 116 connected via respective fold lines 215, 217 along a first set of opposing side edges of the base panel 118.

The side wall sections 116 are substantially a mirror image of each other and each comprises an inner side wall panel 116*a* and an outer side wall panel 116*b*. The inner and outer side wall panels 116*a*, 116*b* are connected via interior fold lines 216*a*, 216*b* which run parallel to one another and are configured such that when folded, the panels 116*a*, 116*b* are positioned adjacent to one another side-by-side but are separated by a gap equal in size to the distance between the interior fold lines 216*a*, 216*b*, which is approximately equal to the thickness of the material. Each side wall section 116 additionally comprises a cut-out region or aperture 132 therein which spans a portion of both panels 116*a*, 116*b*. The cut-out region 132 defines the first recess 24 in upper edge the respective side wall 16 of the container 10 when the blank is folded to form a container. In addition, the panels 116*a*, 116*b* are profiled to define a locking tab 22 at a rearward edge of the side wall 16 in the completed container. Accordingly, each panel 116*a*, 116*b* includes a notch 122*c* along a rear edge which together form the undercut region 22*c* of the locking tab 22 of the container 10, when constructed from the blank 110. The inner panel 116*a* defines a further cut out region 136 which forms the second recess 30 for receiving a locking tab 22, 70 of a further container 10 or stand 60 when the blank is folded to form a container 10. Furthermore, the inner side wall panel 116*a* includes a pair of securing tabs 137*a*, 137*b* positioned along an outer edge of the panel 116*b* either side of the cut-out region 136.

The base panel 118 comprises a pair of opposed locking slot apertures 126 positioned adjacent respective fold lines 215, 217 for the outer side wall panels 116*b* of the first and second side wall sections 116. The locking slot apertures 126 form respective locking slots 26 in the base 18 of a container. Further apertures 138*a*, 138*b* are also defined on either side of the base panel 118, one 138*a* to rear and one 138*b* forwardly of the locking slot aperture 126 to receive respective securing tabs 137*a*, 137*b* to hold the inner side wall panels 116*a* in position when the blank is folded to form a container.

The blank 110 includes a front wall panel 112 and rear wall panel 114 connected via respective fold lines 211, 213 along a second set of opposing end edges of the base panel 118. A pair of first securing flaps 113*a*, 113*b* are connected via respective fold lines 212*a*, 212*b* along opposing side edges of the front wall panel 112. The first securing flaps 113*a*, 113*b* locate between the inner and outer side wall panels 116*a*, 116*b* on their receptive sides when the blank is folded to form a container. Similarly, a pair of second securing flaps 115*a*, 115*b* are connected via respective fold lines 214*a*, 214*b* along opposing side edges of the rear wall panel 114, the second securing flaps 115*a*, 115*b* also being received between the inner and outer side wall panels 116*a*, 116*b* on their receptive sides when the blank is folded to form a container. A rear edge of each of the second securing flaps 115*a*, 115*b* is profiled to define a locking tab portion 122, which aligns with the profiled rear edges of the inner and outer side wall panels 116*a*, 116*b* to define the locking tabs 22 in the completed container.

To form the container 10 from the blank 110, the blank 110 is first folded along fold lines 211, 213 to bring the front and rear wall panels 112, 114 perpendicular to the base panel 118. The blank 110 is then folded along fold lines 212*a*, 212*b* to bring first securing flaps 113*a*, 113*b* perpendicular to the front wall panel 112, and along fold lines 214*a*, 214*b* to bring projecting second securing flaps 115*a*, 115*b* perpendicular to the rear wall panel 114. With the panels 112, 114, and securing flaps 113*a*, 113*b*, 115*a*, 115*b* in position, the blank 110 is then folded along fold lines 215, 217 to bring the second side wall sections 116 perpendicular with the base panel 118.

Each of the side wall sections 116 is folded along their interior fold lines 216*a*, 216*b* to bring the inner side wall panel 116*a* to a position wherein it overlaps the outer side wall panel 116*b* with the respective first and second securing flaps located between the inner and outer side wall panels 116*a*, 116*b*. The inner side wall panel 116*a* is secured in position by locating the securing tabs 137*a*, 137*b* in respective further apertures 138*a*, 138*b* in the base panel 118.

Figure 7:
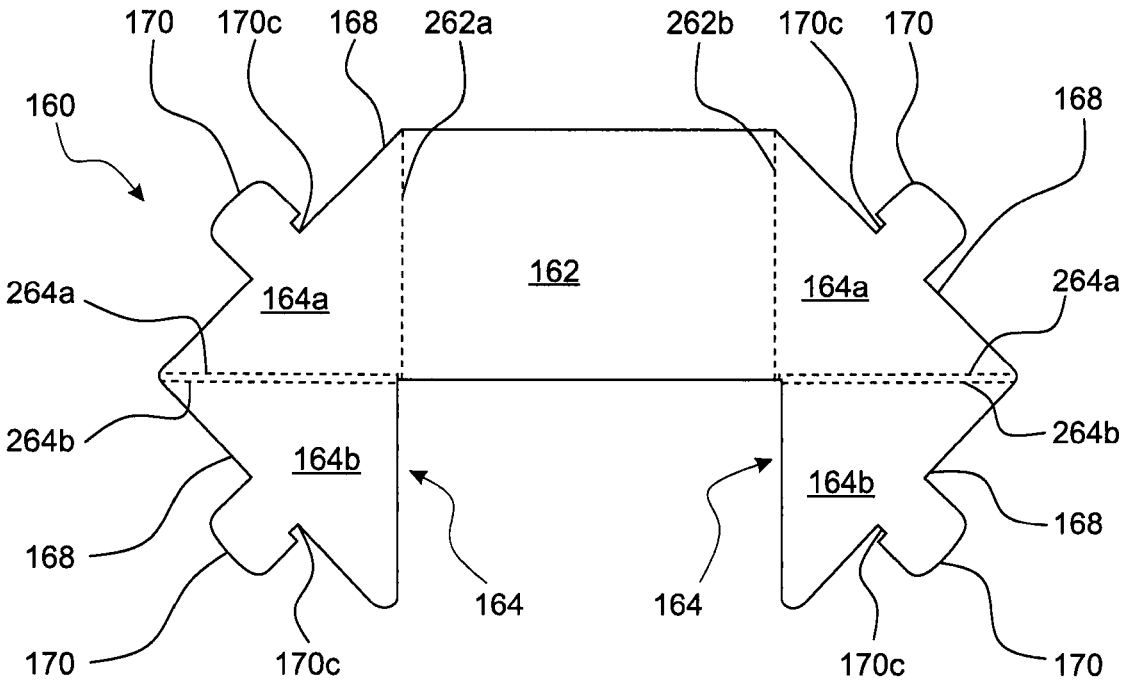
FIG. 7 is a plan view of a blank for forming the stand of FIG. 5.

FIG. 7 illustrates a blank 160 for the construction of the stand 60 for use in embodiments of a display device of the invention. The blank 160 comprises a rear wall panel 162 and a pair of side wall sections 164 connected via respective fold lines 262*a*, 262*b* along opposing edges of the rear wall panel 162.

The side wall sections are a mirror image of each other. Each side wall section 164 comprises a first side wall panel 164*a* and a second side wall panel 164*b*, with each side wall panel being substantially a mirror image of the other. The first and second side wall panels 164*a*, 164*b* are connected via interior fold lines 264*a*, 264*b* which run alongside one another and are configured such that when folded, the panels 164*a*, 164*b* are positioned adjacent to one another, side-by-side. Each side wall panel 164*a*, 164*b* also includes a locking tab portion 170 extending therefrom. The locking tab portions 170 are profiled to define locking tabs 70 in the completed stand 60 and which are similar in profile to the locking tabs 22 of the container and include undercut regions 170*c* between the main body of the tab portion and an upper edge 168 of the respective side wall panel 164*a*, 164*b*. The side wall panels 164*a*, 16*b* are triangular in shape so as to form tapered side walls in the stand.

To form the stand 60 from the blank 160, the blank 160 is folded along fold lines 264*a*, 264*b* to bring the first and second side wall panels 164*a*, 164*b* on either side together, with the lacking tab portions 170 in alignment to define the side walls 64. The panels 164*a*, 164*b* may be securely fastened to one another, by means of an adhesive or the like, for example, to retain the first and second side wall sections 164 in this configuration. The blank is also folded along fold lines 262*a*, 262*b* so that the side walls 64 of the stand project forwardly from the rear wall 66. The side walls 64 of the stand 60 are held in position relative to the rear wall 62 once a container 10 has been mounted to the stand so that no front wall is required. This allows the side walls 64 of the stand 60 to taper very narrowly at their forward edge so that when a container 10 is mounted to the stand, the stand 60 is not visible from the front of the display and the container is brought very close to the surface on which the stand 60 is positioned.

Figure 8:
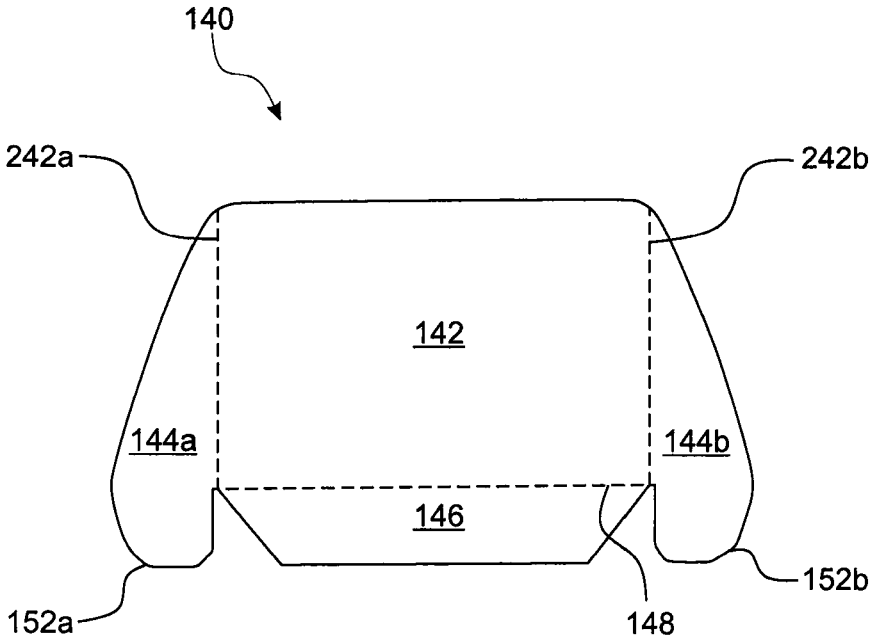
FIG. 8 is a plan view of a blank for forming the header of FIG. 4.

FIG. 8 illustrates a blank 140 for the construction of the header 40 for use in embodiments of a display of the invention. The blank 140 comprises a planer display surface panel 142, a first side wall panel 144*a*, a second side wall panel 144*b* and a securing flap member 146. The first side wall panel 144*a* and second side wall panel 144*b* are connected via respective fold lines 242*a*, 242*b* along opposing edges of the top surface panel 142. The securing flap member 146 is connected via fold line 148 along a further edge of the top surface panel 142. The first and second side wall panels 144*a*, 144*b* comprise respective securing tab members 152*a*, 152*b* at an end thereof. The securing tab members 152*a*, 152*b* form securing tabs 52*a*, 52*b* of the header 40 for securing the header 40 to a container 10, in use. To form the header 40 from the blank 140, the blank 140 is folded along fold lines 242*a*, 242*b* and 148 to bring the first and second side wall panels 144*a*, 144*b* and the securing flap member 146 to a position wherein they are substantially perpendicular to the top surface panel 142.

A modular display device 34 can be formed using any number of containers 10 arranged in a stack or even a single container mounted to a stand 60. The components of the modular display device 34 could be provided as flat blanks for assembly at a retail outlet with product being loaded into the container(s) 10 after construction. Alternatively, the containers 10 may be pre-filled with product and supplied to a retailer who assembles them into a display device 34 together with a stand 60 and optionally a header 40. Where the containers 10 are pre-filled, they may be provided with removable lid sections or other closure means to hold the product in the containers during transport. It will be noted that the use of a separate stand 60 to incline the containers 10 means that the upper surfaces of the walls 12, 14, 16 of the containers can be aligned parallel to the base 18 so that the containers 10 define standard cuboid shape which is useful for stacking during storage and transport. Furthermore, it will be noted that the locking tabs 22 are defined within the side walls 16 of the containers and do not project beyond the upper edge of the side walls and so are less susceptible to damage during transport and storage. Furthermore, forming the locking tabs 22 using both the inner and outer side wall panels 116*a*, 116*b* and further supported by the locking tab portions 112 of second securing flaps 115*a*, 115*b* means that each locking tab is made from three thickness of material for additional strength.

The above embodiments are described by way of example only. Many variations are possible without departing from the scope of the invention as defined in the appended claims.

The invention claimed is:

1. A container, constructed from a blank of foldable material and adapted to be stacked together with other similar containers to form a modular display device, the container comprising a base, a pair of opposed side walls extending upwardly from the base, and opposed front and rear walls extending upwardly from the base between said opposed side walls, said base and said walls defining an enclosure for storing and displaying one or more items, a locking tab being defined in an upper edge region of each side wall and a pair of corresponding locking slots being defined in the base, the locking tabs and locking slots being configured such that, in use, the container is detachably mountable on a similar container by insertion of the locking tabs of the similar container into the corresponding locking slots of the container; wherein each locking tab comprises a neck portion and a body portion with the body portion overhanging the neck portion to define an undercut and wherein a first recess is defined in the upper edge region of each of the opposed side walls, each first recess extending from a forward edge of the respective locking tab forwardly over part of the remaining length of the side wall.

2. The container according to claim 1, wherein the undercut opens in a rearward direction.

3. The container according to claim 1, wherein each locking tab is defined at a rearward end of a respective side wall.

4. The container according to claim 1, wherein the corresponding locking slots are defined in the base at positions which are offset forwardly from the respective locking tabs, such that, in use, the container is mountable on a similar container with the front wall of the container offset rearwardly from the front wall of the similar container.

5. The container according to claim 1, wherein the locking tabs and locking slots are configured such that, in use, the container is mountable on top of a similar container with the body portion of each of the locking tabs of the similar container insertable through a corresponding locking slot in the container and the base of the container engageable within the undercut.

6. The container according to claim 1, wherein the container is configured such that, in use, the container is mountable on top of a similar container with a region of the base of the container between forward edges of the locking slots and the front wall receivable in the first recesses of the similar container.

7. The container according to claim 1, wherein each first recess is longer than a distance between the forward end of the locking slots and the front wall.

8. The container according to claim 1, wherein each of the opposed side walls comprises an inner panel and an outer panel, the inner panel defining a second recess in a lower edge region of the panel in alignment with a respective one of the locking slots, the second recess being configured to receive at least a body portion of the locking tab of a similar container insertable through the respective locking slot in use.

9. A blank for the manufacture of the container according to claim 1 comprising:

a first side wall section and a second side wall section a front wall panel and a rear wall panel; and a base panel, connected by fold lines along a first set of opposing end edges to the front and rear panels, and connected by fold lines along a second set of opposing side edges to the first side wall section and the second side wall section, the base comprising a pair of opposed locking slot apertures located along respective side edges to define the locking slots when the blank is assembled into the container;

wherein each side wall section comprises an inner side wall panel and an outer side wall panel separated by at least one fold line, the rear edges of the inner side wall panel and the outer side wall panel in each side wall section being profiled to define a respective one of the locking tabs when the blank is assembled into the container;

and wherein an aperture is provided in each side wall section, said aperture extending across the fold line and configured to define a respective one of said first recesses when the blank is assembled into the container.

10. A blank according to claim 9, wherein the front wall panel and the rear wall panel each have a securing flap connected to either side edge by a fold line, the securing flaps being configured for insertion between the inner side wall panel and the outer side wall panel of a respective side wall when the blank is folded to form a container.

11. A blank according to claim 10, wherein each of the securing flaps connected to the rear wall panel are profiled along a rear edge to define a locking tab together with the inner side wall panel and the outer side wall panel of a respective side wall section when the blank is folded to form a container.

12. A modular display device comprising at least one container in accordance with claim 1.

13. The modular display device according to claim 12, wherein the modular display device comprises a stand to which said at least one container can be mounted, the stand being made from a blank of foldable material and comprising a pair of side walls connected along fold lines to opposing side edges of a rear wall, the side walls having upper surfaces which are inclined downwardly from the rear wall toward a forward edge, a locking tab projecting form the upper surface of each side wall for insertion in a respective locking slot of said at least one container.

14. The modular display device as according to claim 13, wherein the locking tabs on the stand each comprise a neck portion and a body portion overhanging the neck portion to define an undercut, the base of the at least one container being engageable in the undercut.

15. The modular display device according to claim 12, the display device comprising a header mountable to said at least one container.

16. A method for forming a display device from the modular display device of claim 12, the method comprising detachably mounting at least two containers one above another to form a stack, a first of the containers in the stack being mounted on top of a second of the containers by inserting each locking tab of the second of the containers through a respective locking slot of the first of the containers, the base of the first of the containers engaging in the undercuts defined by the locking tabs of the second of the containers.

17. The method according to claim 16, wherein the modular display device comprises a stand to which said at least one container can be mounted, the stand being made from a blank of foldable material and comprising a pair of side walls connected along fold lines to opposing side edges of a rear wall, the side walls having upper surfaces which are inclined downwardly from the rear wall toward a forward edge, a locking tab projecting from the upper surface of each side wall for insertion in a respective locking slot of said at least one container, the method further comprising mounting a lowermost container in the stack to the stand by inserting each locking tab of the stand within a respective locking slot of the lowermost container, the base of the lowermost container engaging in the undercuts defined by the locking tabs of the stand.

18. A modular display device comprising two or more containers according to claim 1 mountable one above another to form a stack, and the containers are connectable together in adjacent pairs to form the stack by inserting the locking tabs in a lower container of each pair into the respective locking slots of the upper container in each pair, with the base of the upper container in each pair engaging in the undercut defined in the locking tabs of the lower container in each pair.

* * * * *